US010175706B2

(12) United States Patent
Golara et al.

(10) Patent No.: US 10,175,706 B2
(45) Date of Patent: Jan. 8, 2019

(54) COMPENSATED LOW DROPOUT WITH HIGH POWER SUPPLY REJECTION RATIO AND SHORT CIRCUIT PROTECTION

(71) Applicant: QUALCOMM Incorporated, San Diego, CA (US)

(72) Inventors: Soheil Golara, Irvine, CA (US); Babak Vakili-Amini, Irvine, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/186,411

(22) Filed: Jun. 17, 2016

(65) Prior Publication Data

US 2017/0364110 A1 Dec. 21, 2017

(51) Int. Cl.
*G05F 1/575* (2006.01)
*G05F 1/573* (2006.01)

(52) U.S. Cl.
CPC ..... *G05F 1/575* (2013.01); *G05F 1/573* (2013.01)

(58) Field of Classification Search
CPC ..... G05F 1/575; G05F 1/573
See application file for complete search history.

(56) References Cited

U.S. PATENT DOCUMENTS 6,246,221 B1 * 6/2001 Xi ..... G05F 1/575 323/280
6,340,918 B2 1/2002 Taylor
6,522,112 B1 2/2003 Schmoock et al.
6,977,490 B1 * 12/2005 Zhang ..... G05F 1/575 323/280
7,002,409 B1 2/2006 Aram
7,446,515 B2 11/2008 Wang
8,872,492 B2 10/2014 Zhang et al.
2003/0111986 A1 6/2003 Xi
2005/0189930 A1 * 9/2005 Wu ..... G05F 1/575 323/280
2006/0043945 A1 3/2006 Sohn et al.
2008/0157735 A1 * 7/2008 Liu ..... G05F 1/575 323/280

(Continued)

FOREIGN PATENT DOCUMENTS

EP 2816438 A1 12/2014

OTHER PUBLICATIONS

Coulot T., et al., "Fully Integrated Power Management Unit (PMU) using NMOS Low Dropout Regulators", EUROCON 2013, Jul. 1, 2013, XP032497765, DOI: 10.11 09/EUROCON.2013.6625168, ISBN: 978-1-4673-2230-0, [retrieved on Oct. 8, 2013], pp. 1445-1452.

(Continued)

*Primary Examiner* — Jue Zhang
(74) *Attorney, Agent, or Firm* — Muncy, Geissler, Olds & Lowe, P.C.

(57) ABSTRACT

Disclosed is a low dropout (LDO) voltage regulator that includes a differential amplifier configured to amplify a differential between a reference voltage and a regulated output voltage, a pass transistor coupled to the differential amplifier and driven by an output of the differential amplifier, a compensation capacitor coupled to an output node of the differential amplifier, and an auxiliary amplifier, wherein an output node of the auxiliary amplifier is coupled to the compensation capacitor, and wherein an input node of the auxiliary amplifier is coupled to the pass transistor.

24 Claims, 6 Drawing Sheets

(56) References Cited

U.S. PATENT DOCUMENTS

| | | | | |
|---|---|---|---|---|
| 2009/0001953 | A1* | 1/2009 | Huang | G05F 1/575 323/281 |
| 2013/0285631 | A1* | 10/2013 | Bisson | G05F 1/575 323/280 |
| 2017/0023958 | A1* | 1/2017 | Dixit | G05F 1/56 |

OTHER PUBLICATIONS

International Search Report and Written Opinion—PCT/US2017/033812—ISA/EPO—dated Jul. 31, 2017.

Grasso A.D., et al., "Comparison of the Frequency Compensation Techniques for CMOS Two-Stage Miller OTAs", IEEE Transactions on Circuits and Systems II: Express Briefs, IEEE, US, vol. 53, No. 11, Nov. 1, 2008 (Nov. 1, 2008), pp. 1099-1103, XP011239591, ISSN: 1549-7747.

Palumbo G., et al., "Design Methodology and Advances in Nested-Miller Compensation", IEEE Transactions on Circuits and Systems Part 1: Regular Papers, IEEE Service Center, New York, NY, US, vol. 49, No. 7, Jul. 1, 2002 (Jul. 1, 2002), XP011071305, ISSN: 1057-7122.

* cited by examiner

-- Prior Art --

COMPENSATED LOW DROPOUT WITH HIGH POWER SUPPLY REJECTION RATIO AND SHORT CIRCUIT PROTECTION

INTRODUCTION

Aspects of this disclosure relate to compensated low dropout (LDO) voltage regulators with high power supply rejection ratio (PSRR) and short circuit protection.

Power management plays an important role in the electronics industry. Battery powered and handheld devices require power management techniques to extend battery life and improve the performance and operation of the devices. One aspect of power management includes controlling operational voltages. Conventional electronic systems, particularly systems on-chip (SOCs) commonly include various subsystems. The various subsystems may be operated under different operational voltages tailored to the specific needs of the subsystems.

Voltage regulators are employed to deliver specified voltages to the various subsystems. Voltage regulators may also be employed to keep the subsystems isolated from one another. Low dropout (LDO) voltage regulators are commonly used to generate and supply fixed voltages, and achieve low-noise circuitry.

SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

A low dropout (LDO) voltage regulator includes a differential amplifier configured to amplify a differential between a reference voltage and a regulated output voltage, a pass transistor coupled to the differential amplifier and driven by an output of the differential amplifier, a compensation capacitor coupled to an output node of the differential amplifier, and an auxiliary amplifier, wherein an output node of the auxiliary amplifier is coupled to the compensation capacitor, and wherein an input node of the auxiliary amplifier is coupled to the pass transistor.

A method for compensating an LDO voltage regulator includes amplifying, by a differential amplifier, a differential between a reference voltage and a regulated output voltage, receiving, at a pass transistor coupled to the differential amplifier, an output of the differential amplifier, receiving, at a compensation capacitor, an output signal from an auxiliary amplifier, wherein the compensation capacitor is coupled to an output node of the differential amplifier, wherein an output node of the auxiliary amplifier is coupled to the compensation capacitor, and wherein an input node of the auxiliary amplifier is coupled to the pass transistor.

An apparatus for compensating an LDO voltage regulator includes a differential amplifier configured to amplify a differential between a reference voltage and a regulated output voltage, a pass transistor coupled to the differential amplifier and driven by an output of the differential amplifier, a compensation means coupled to an output node of the differential amplifier, and an auxiliary amplification means, wherein an output node of the auxiliary amplification means is coupled to the compensation means, and wherein an input node of the auxiliary amplification means is coupled to the pass transistor.

A non-transitory computer-readable medium for compensating an LDO voltage regulator includes at least one instruction to amplify, by a differential amplifier, a differential between a reference voltage and a regulated output voltage, at least one instruction to receive, at a pass transistor coupled to the differential amplifier, an output of the differential amplifier, at least one instruction to receive, at a compensation capacitor, an output signal from an auxiliary amplifier, wherein the compensation capacitor is coupled to an output node of the differential amplifier, wherein an output node of the auxiliary amplifier is coupled to the compensation capacitor, and wherein an input node of the auxiliary amplifier is coupled to the pass transistor.

Other objects and advantages associated with the aspects and embodiments disclosed herein will be apparent to those skilled in the art based on the accompanying drawings and detailed description.

BRIEF DESCRIPTION OF THE DRAWINGS

A more complete appreciation of embodiments of the disclosure will be readily obtained as the same becomes better understood by reference to the following detailed description when considered in connection with the accompanying drawings which are presented solely for illustration and not limitation of the disclosure, and in which.

DETAILED DESCRIPTION

Figure 1:
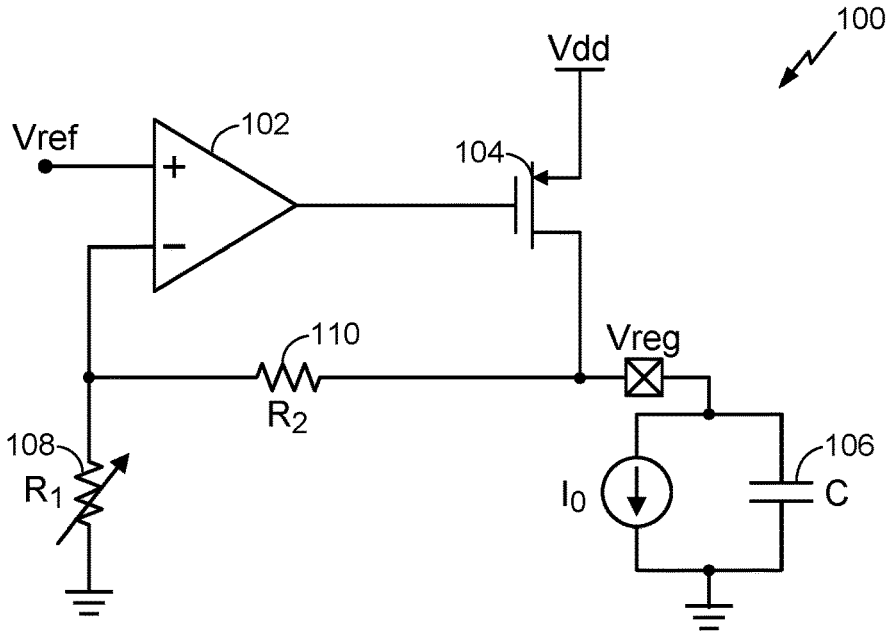
FIG. 1 illustrates a conventional low dropout (LDO) voltage regulator.

Disclosed is a low dropout (LDO) voltage regulator that includes a differential amplifier configured to amplify a differential between a reference voltage and a regulated output voltage, a pass transistor coupled to the differential amplifier and driven by an output of the differential amplifier, a compensation capacitor coupled to an output node of the differential amplifier, and an auxiliary amplifier, wherein an output node of the auxiliary amplifier is coupled to the compensation capacitor, and wherein an input node of the auxiliary amplifier is coupled to the pass transistor.

A method for compensating an LDO voltage regulator includes amplifying, by a differential amplifier, a differential between a reference voltage and a regulated output voltage, receiving, at a pass transistor coupled to the differential amplifier, an output of the differential amplifier, receiving, at a compensation capacitor, an output signal from an auxiliary amplifier, wherein the compensation capacitor is coupled to an output node of the differential amplifier, wherein an output node of the auxiliary amplifier is coupled to the compensation capacitor, and wherein an input node of the auxiliary amplifier is coupled to the pass transistor.

These and other aspects of the disclosure are disclosed in the following description and related drawings directed to specific embodiments of the disclosure. Alternate embodiments may be devised without departing from the scope of the disclosure. Additionally, well-known elements of the disclosure will not be described in detail or will be omitted so as not to obscure the relevant details of the disclosure.

The words "exemplary" and/or "example" are used herein to mean "serving as an example, instance, or illustration." Any embodiment described herein as "exemplary" and/or "example" is not necessarily to be construed as preferred or advantageous over other embodiments. Likewise, the term "embodiments of the disclosure" does not require that all embodiments of the disclosure include the discussed feature, advantage or mode of operation.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, these sequence of actions described herein can be considered to be embodied entirely within any form of computer readable storage medium having stored therein a corresponding set of computer instructions that upon execution would cause an associated processor to perform the functionality described herein. Thus, the various aspects of the disclosure may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Power management plays an important role in the electronics industry. Battery powered devices require power management techniques to extend battery life and improve the performance and operation of the devices. One aspect of power management includes controlling operational voltages. Conventional electronic systems, particularly systems on-chip (SOCs) commonly include various subsystems. The various subsystems may be operated under different operational voltages tailored to the specific needs of the subsystems.

An operational amplifier (referred to as an "op-amp") is a direct current (DC)-coupled high-gain electronic voltage amplifier with a differential input and, often, a single-ended output. In this configuration, an op-amp produces an output potential (relative to circuit ground) that is typically hundreds of thousands of times larger than the potential difference between its input terminals. More specifically, the op-amp's differential inputs consist of a non-inverting input (+) with voltage $V_+$ and an inverting input (−) with voltage $V_-$. Ideally, the op-amp amplifies only the difference in voltage between the two, which is referred to as the differential input voltage. If predictable operation is desired, negative feedback is used by applying a portion of the output voltage to the inverting input. This closed loop feedback greatly reduces the gain of the circuit.

Voltage regulators are employed to deliver specified voltages to the various subsystems of a device. Voltage regulators may also be employed to keep the subsystems isolated from one another. Low dropout (LDO) voltage regulators are commonly used to generate and supply fixed voltages, and achieve low-noise circuitry.

An LDO is a closed-loop op-amp. When an LDO has to drive a large off-chip capacitor (referred to as a "load capacitor") and supply a large current, it is very difficult to compensate the op-amp to ensure stability. The wide range of load capacitors and load currents makes it much harder to satisfy stability and the power supply rejection ratio (PSRR) for the circuit at the same time. The PSRR is defined as the ratio of the change in supply voltage in the op-amp to the equivalent output voltage it produces, often expressed in decibels (dB). An ideal op-amp would have infinite PSRR.

FIG. 1 illustrates a conventional LDO voltage regulator 100. As illustrated in FIG. 1, a differential amplifier 102 (also referred to as an "error amplifier") of the LDO voltage regulator 100 accepts an input reference voltage $V_{ref}$, and generates a regulated output voltage $V_{reg}$. The output of the differential amplifier increase dramatically 102 drives a large pass transistor, transistor 104 (which may, in an aspect, be a p-channel metal oxide semiconductor (PMOS)). The LDO voltage regulator 100 further includes a load capacitor (C) 106 and resistors $R_1$ 108 and $R_2$ 110. The LDO voltage regulator 100 supplies a load current $I_0$ for other sub-blocks of the SoC. Note that the load current $I_0$ is not associated with the load capacitor 106. The load current $I_0$ supplies the rest of the system and the load capacitor 106 is added so that the LDO voltage regulator 100 can provide a fixed and low noise output voltage. The resistors $R_1$ 108 and $R_2$ 110 form the feedback circuit. Adjusting one of them is enough to program the output voltage of the LDO voltage regulator 100.

An LDO voltage regulator, such as LDO voltage regulator 100 of FIG. 1, is a "two pole" system. A "pole" and "zero" is an indication of stability of the electrical circuit. More specifically, the frequencies of poles and zeros of the system (i.e., the LDO voltage regulator 100), define the loop gain and loop phase plotted versus frequency. In order to maintain stability of the circuit at these poles, the poles are compensated with other circuit elements that act as damping factors on the loop gain. If multiple poles exist, for example, due to multiple resistor-capacitor combinations, focus may be placed on compensating the dominant pole. In such systems, it is desirable that a non-dominant pole lies far apart from the dominant pole. This pole arrangement should be realized through a method of compensation.

Returning to FIG. 1, there are two (relatively) low frequency poles at the gate of the pass device (e.g., transistor 104) and at the load (e.g., load capacitor 106). To ensure stability, the LDO voltage regulator 100 needs to be compensated.

In an example, the LDO voltage regulator 100 may be a high-power 1.1V digital base-band LDO biased with a positive supply voltage $V_{dd}$, such as 1.8V, and providing 1.1V regulated voltage. In this example, the current ($I_0$) varies from 5 uA to 50 mA and the load capacitor 106 is a large-load off-chip bypass capacitor with a capacitance from 3.3 to approximately 10 uF. Note that 10 uF is an extreme case for stability. For circuits with large transient currents, a large off-chip bypass capacitor (e.g., load capacitor 106) is used to improve the load regulation and reduce voltage transients.

The challenges of compensating an op-amp to satisfy stability and the PSRR at the same time become more difficult to address when designing for an ultra-low power application, such as a battery-operated device and large off-chip bypass capacitor (e.g., load capacitor 106). Conventionally, Miller compensation is a robust method of op-amp stabilization, but considering the above-noted challenges, it requires a large compensation capacitor that cannot be placed on the chip. It also provides no power supply rejection (PSR). Therefore, there is a need for a compensated op-amp with an affordable capacitor that provides sufficient PSRR as well.

The present disclosure introduces an auxiliary amplifier to the LDO voltage regulator. More specifically, an auxiliary amplifier is added before the compensation capacitor. Based on the gain provided by the auxiliary amplifier, the effect of the compensation capacitor is increased. For example, if the auxiliary amplifier provides 20 dB gain, it makes the effect of the compensation capacitor 10 times larger. Thus, the compensation capacitor can be 10 times smaller. For example, if the compensation capacitor for classical Miller compensation is 400 pico Farad (pF), the compensation capacitor for the compensator with an auxiliary amplifier only needs to be 40 pF (i.e., 400 pF reduced 10 times, or divided by 10).

Figure 2:
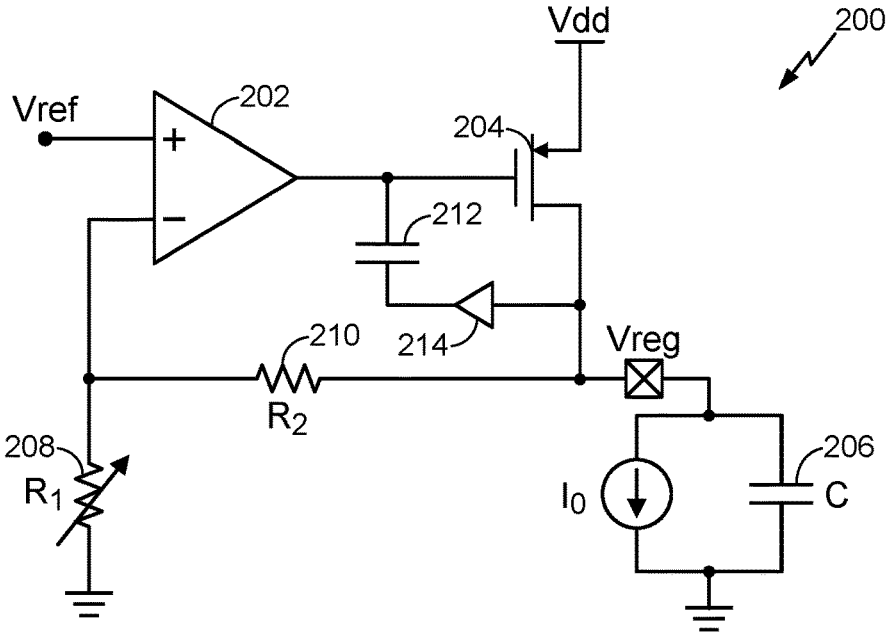
FIG. 2 illustrates an LDO voltage regulator that includes an auxiliary amplifier according to at least one aspect of the disclosure.

FIG. 2 illustrates an LDO voltage regulator 200 that includes an auxiliary amplifier 214 and a compensation capacitor 212 according to at least one aspect of the disclosure. As in FIG. 1, a differential amplifier 202 of the LDO voltage regulator 200 accepts an input reference voltage $V_{ref}$, and generates a regulated output voltage $V_{reg}$. The output of the differential amplifier 202 drives a large pass transistor, transistor 204 (which may, in an aspect, be a PMOS). Similar to the LDO voltage regulator 100, the LDO voltage regulator 200 further includes a load capacitor (C) 206 and resistors $R_1$ 208 and $R_2$ 210. It supplies a load current $I_0$ for other sub-blocks of the system. However, in contrast to the LDO voltage regulator 100, the LDO voltage regulator 200 includes an auxiliary amplifier 214 before the compensation capacitor 212, as described above.

The benefits of adding the auxiliary amplifier 214 before the compensation capacitor 212 include a reduction in the size of the compensation capacitor 212 by the amount of the gain of the auxiliary amplifier 214, as described above. For example, if the auxiliary amplifier 214 provides 20 dB gain, it makes the effect of the compensation capacitor 212 10 times larger. Thus, the compensation capacitor 212 can be 10 times smaller than it would otherwise have to be if the LDO voltage regulator 200 only included the auxiliary amplifier 214. In addition, the PSRR improves by the amount of the gain of the auxiliary amplifier 214. Without the auxiliary amplifier 214, at high frequencies, the supply noise would couple directly to the LDO output and there would not be any supply rejection.

In an embodiment, an LDO voltage regulator (such as LDO voltage regulator 100) can include a short circuit clamp. Such an LDO voltage regulator can receive a positive supply voltage $V_{dd}$ from the battery (e.g., 2V to 3.6V) and provide a regulated output voltage $V_{reg}$, such as 1.8V. For large input voltages, it is preferable to have short circuit protection because the gate-source voltages of the PMOS device (e.g., transistor 104) can become as large as 3.6V and generate a large current in the LDO voltage regulator if the output is shorted. Adding a series resistor with the output of the PMOS can limit such a short circuit, but with the low voltage headroom and the large current that such an LDO voltage regulator provides, it is preferable to avoid the V=I*R voltage drop.

To address these issues, an active clamp can be added to the LDO voltage regulator. The active clamp should preferably be non-linear to ensure that it is not engaged in the normal operation of the LDO voltage regulator, but rather, holds the PMOS gate to limit the short-circuit surge of the current.

Figure 3:
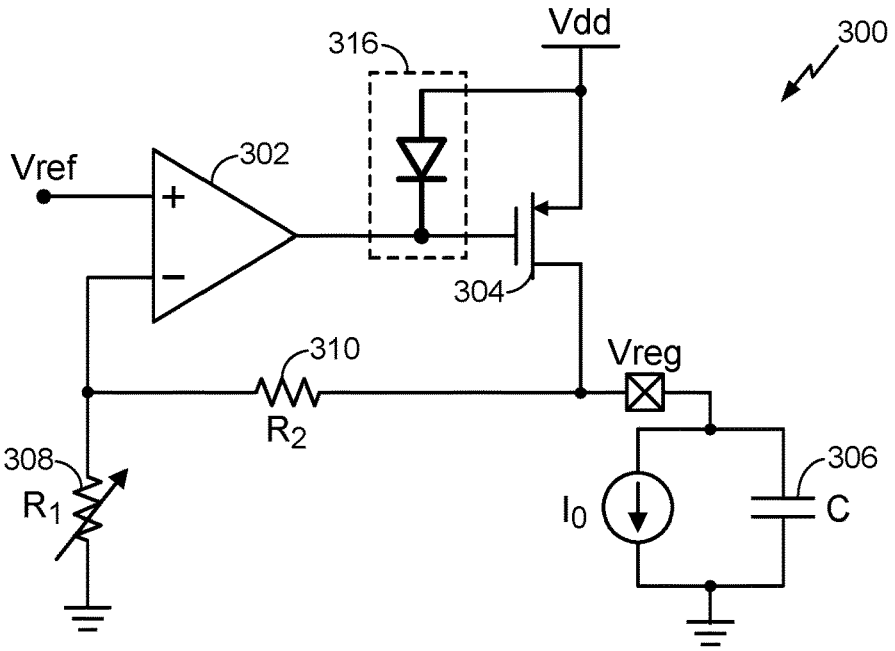
FIG. 3 illustrates an LDO voltage regulator that includes an active clamp according to at least one aspect of the disclosure.

FIG. 3 illustrates an LDO voltage regulator 300 that includes an active clamp 316 according to at least one aspect of the disclosure. Similar to the LDO voltage regulator 100 in FIG. 1, a differential amplifier 302 of the LDO voltage regulator 300 accepts an input reference voltage $V_{ref}$ and generates a regulated output voltage. The output of the differential amplifier 302 drives a large pass transistor, transistor 304 (which may, in an aspect, be a PMOS). Like the LDO voltage regulator 100, the LDO voltage regulator 300 further includes a load capacitor (C) 306 and resistors $R_1$ 308 and $R_2$ 310. It supplies a load current $I_0$ for other sub-blocks of the system.

As shown in FIG. 3, an active clamp 316 is placed between the differential amplifier 302 and the transistor 304. The design of the active clamp 316 (shown in FIG. 7) in the LDO voltage regulator 300 intensifies its nonlinearity as opposed to typical CMOS nonlinearity. It also provides a high output resistance to not disturb the op-amp gain and offers a degree of freedom in designing the output resistance. The LDO voltage regulator 300 is supplied with a positive supply voltage $V_{dd}$ from a battery of, for example, 2V to 3.6V, and supplies the off-chip load capacitor with a regulated output voltage $V_{reg}$ of, for example, 1.8V. Without the active clamp 316, the LDO voltage regulator 300 would not have short-circuit protection.

Figure 4:
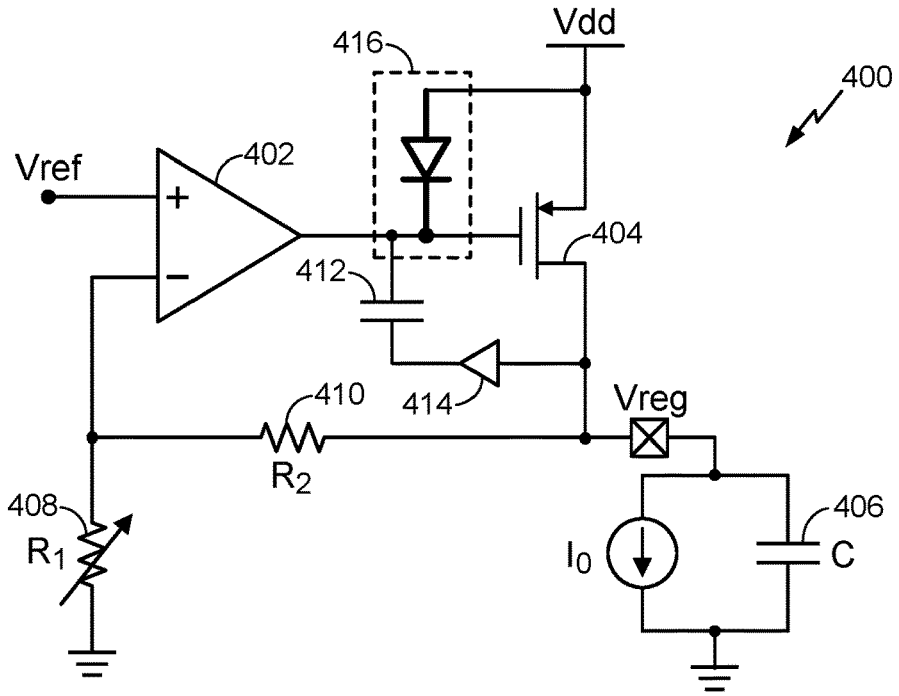
FIG. 4 illustrates an LDO voltage regulator 400 that includes an auxiliary amplifier, a compensation capacitor, and an active clamp according to at least one aspect of the disclosure.

FIG. 4 illustrates an LDO voltage regulator 400 that includes an auxiliary amplifier 414, a compensation capacitor 412, and an active clamp 416 according to at least one aspect of the disclosure. As in FIG. 2, a differential amplifier 402 of the LDO voltage regulator 400 accepts an input reference voltage $V_{ref}$, and generates a regulated output voltage. The output of the differential amplifier 402 drives a large pass transistor, transistor 404 (which may, in an aspect, be a PMOS device). The LDO voltage regulator 400 further includes a load capacitor (C) 406, resistors $R_1$ 408 and $R_2$ 410, and an auxiliary amplifier 414 before the compensation capacitor 412, as described above.

In the example of FIG. 4, the LDO voltage regulator 400 also includes an active clamp 416, as described above with reference to FIG. 3, placed between the differential amplifier 402 and the transistor 404. Similar to the LDO voltage regulator 300, the LDO voltage regulator 400 is supplied with a positive supply voltage $V_{dd}$ from a battery of, for example, 2V to 3.6V, and supplies the off-chip load capacitor with a regulated output voltage of, for example, 1.8V.

Figure 5:
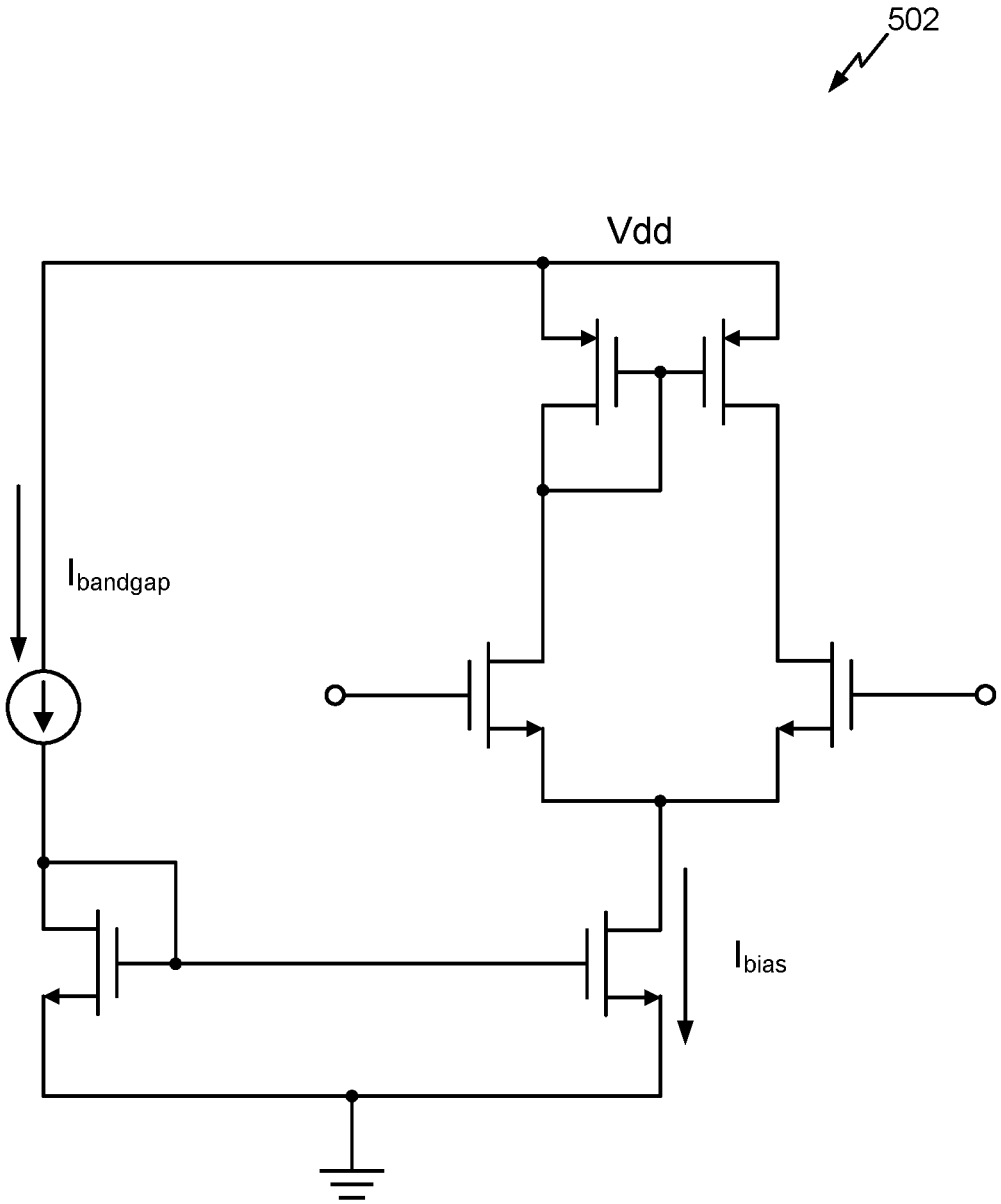
FIG. 5 illustrates an exemplary differential amplifier according to at least one aspect of the disclosure.

FIG. 5 is a diagram of a differential amplifier 502, such as differential amplifier 202 in FIG. 2, differential amplifier 302 in FIG. 3, or differential amplifier 402 in FIG. 4, according to at least one aspect of the disclosure. The differential amplifier 502 uses a low bias current $I_{bias}$, such as 1.2 micro amps (uA), because, as noted above, it is utilized in a low power battery-operated device (e.g., the positive supply voltage $V_{dd}$ of the differential amplifier 502 may be 1.3V). The differential amplifier 502 is biased with, for example, 800 mV DC voltage and, for example, a 25 nano amp (nA) current provided by the bandgap current $I_{bandgap}$.

Figure 6:
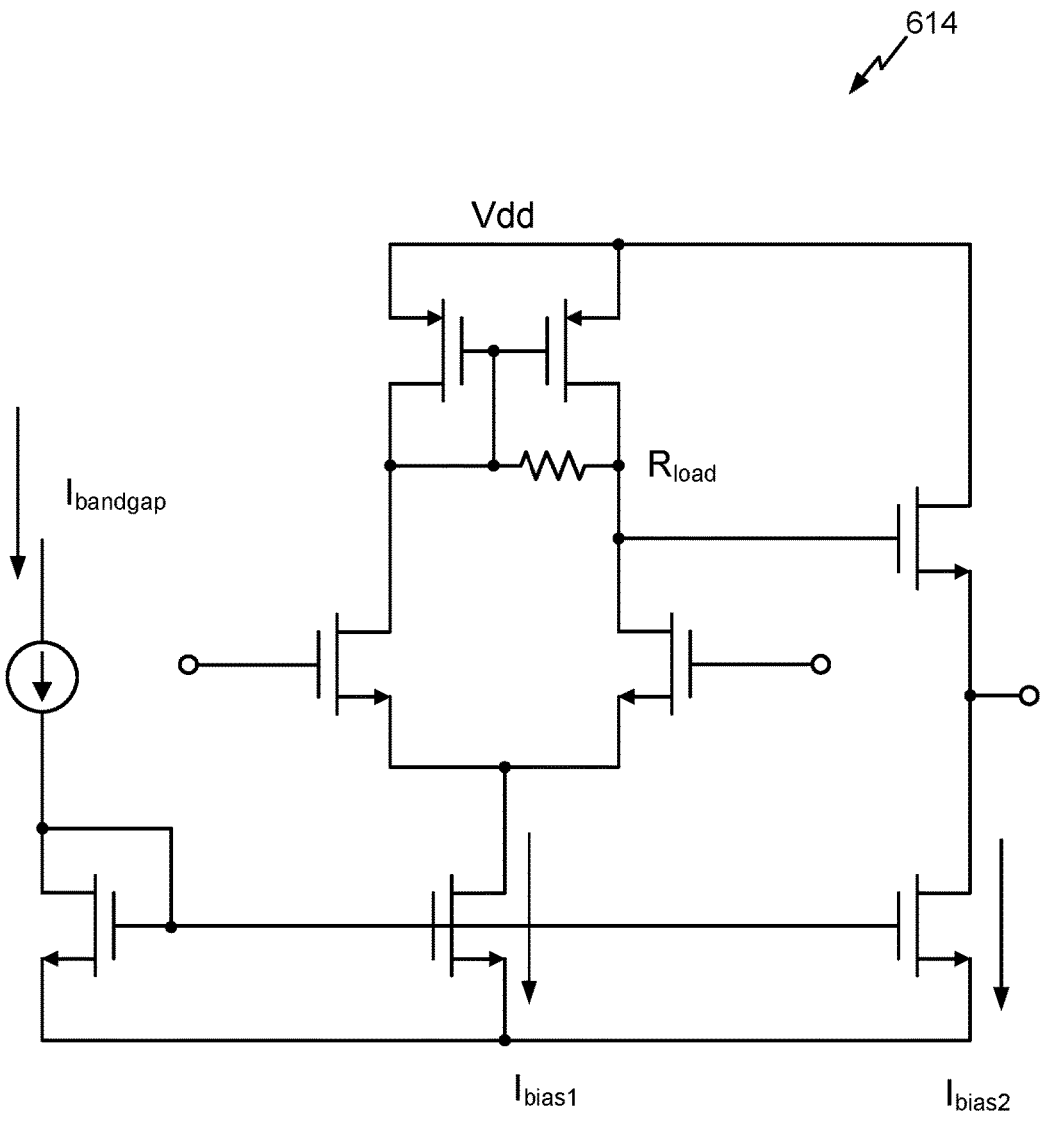
FIG. 6 illustrates an exemplary auxiliary amplifier according to at least one aspect of the disclosure.

FIG. 6 is a diagram of an auxiliary amplifier 614, such as the auxiliary amplifier 214 in FIG. 2, the auxiliary amplifier 314 in FIG. 3, and the auxiliary amplifier 414 in FIG. 4, according to at least one aspect of the disclosure. The auxiliary amplifier 614 is a low power open loop differential amplifier with a resistive load $R_{load}$, such as 5 MΩ, to limit the gain. In an example, the positive supply voltage $V_{dd}$ may be 1.3V, the bandgap current $I_{bandgap}$ may be 25 nA, a first bias current $I_{bias1}$ may be 650 nA, and a second bias current $I_{bias2}$ may be 1.4 uA.

Figure 7:
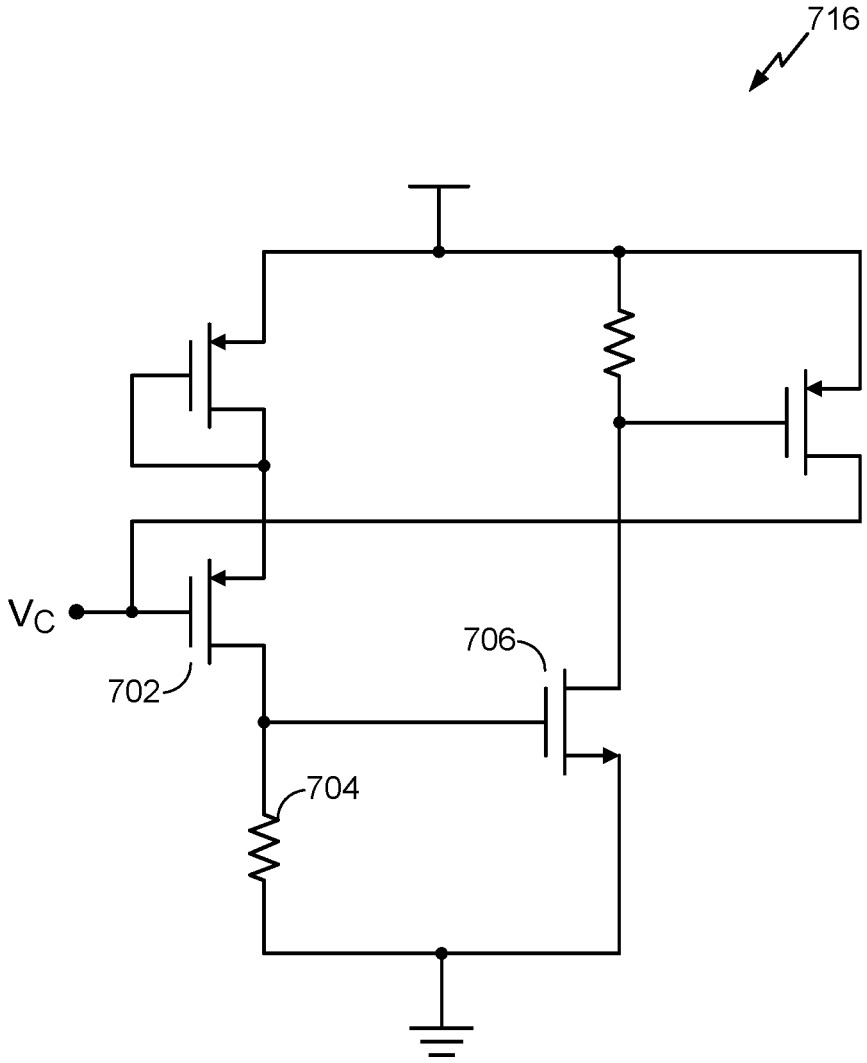
FIG. 7 illustrates an active clamp design according to at least one aspect of the disclosure.

FIG. 7 is a diagram of an active clamp 716, such as the active clamp 316 in FIG. 3 and/or the active clamp 416 in FIG. 4, according to at least one aspect of the disclosure. When the output of the LDO voltage regulator (e.g., LDO voltage regulator 300 in FIG. 3 or LDO voltage regulator 400 in FIG. 4) is shorted, in the absence of the active clamp 716, the gate voltage of the pass device (e.g., transistor 304 in FIG. 3 or the transistor 404 in FIG. 4), also referred as, control voltage $V_C$, would drop too much (e.g., below 100 mV) and a significant surge of current (e.g., as large as 2 amps) would pass through the pass device. In the presence of the active clamp 716, however, a voltage drop in $V_C$ causes a current flow in device 702. This current passes through a resistor 704 and is then amplified by another device 706 to intensify its nonlinearity with respect to $V_C$. A small drop (e.g., 0.5V) in the $V_C$ causes a current to be injected into node $V_C$. Without the active clamp 716, $V_C$ can drop all the way to 0V. The injected current is sinked by the differential amplifier (e.g., differential amplifier 302 in FIG. 3 or differential amplifier 402 in FIG. 4) and the limited bias current of the differential amplifier limits the current in the active clamp 716. As a result, the $V_C$ cannot drop too much. For example, with a 3.6V battery voltage in the LDO voltage regulator, a 2V drop in $V_C$ would be too much, while a 0.5V drop in $V_C$ could be tolerated. In terms of a surge of the current, a current of 2 A would be too much while a current of 200 mA would be tolerable.

Figure 8:
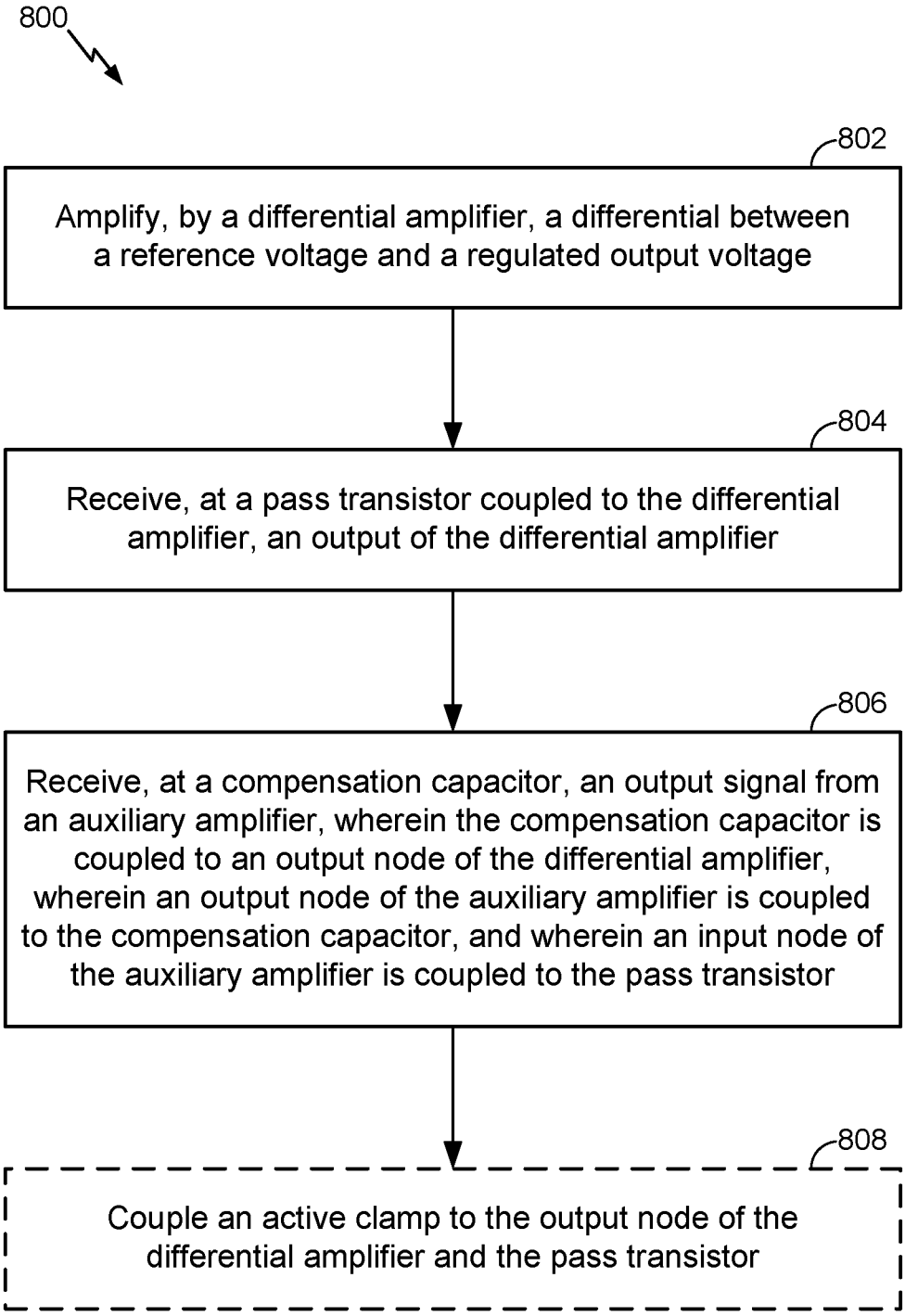
FIG. 8 illustrates an exemplary flow for compensating an LDO voltage regulator according to at least one aspect of the disclosure.

FIG. 8 illustrates an exemplary flow 800 for compensating an LDO voltage regulator according to at least one aspect of the disclosure. The LDO voltage regulator may be a closed loop operational amplifier. In an aspect, the LDO voltage regulator may utilize Miller compensation.

At 802, the flow 800 includes amplifying, by a differential amplifier (e.g., differential amplifier 202 in FIG. 2, differential amplifier 302 in FIG. 3, or differential amplifier 402 in FIG. 4), a differential between a reference voltage and a regulated output voltage.

At 804, the flow 800 includes receiving, at a pass transistor coupled to the differential amplifier (e.g., transistor 204 in FIG. 2, transistor 304 in FIG. 3, or transistor 404 in FIG. 4), an output of the differential amplifier.

At 806, the flow 800 includes receiving, at a compensation capacitor (e.g., compensation capacitor 212 in FIG. 2 or compensation capacitor 412 in FIG. 4), an output signal from an auxiliary amplifier (e.g., auxiliary amplifier 214 in FIG. 2 or auxiliary amplifier 414 in FIG. 4). As illustrated in FIGS. 2 and 4, the compensation capacitor may be coupled to an output node of the differential amplifier, an output node of the auxiliary amplifier may be coupled to the compensation capacitor, and an input node of the auxiliary amplifier may be coupled to the pass transistor. The auxiliary amplifier may be a low current open loop differential amplifier. For example, the low current may be a current of 25 nano amps.

At 808, the flow 800 optionally includes coupling an active clamp to the output node of the differential amplifier and the pass transistor. The active clamp limits short-circuit current surges from the pass transistor. The pass transistor receives a voltage of 2V to 3.6V from a battery, and the LDO voltage regulator supplies an off-chip load capacitor with a voltage of 1.8V.

In an aspect, the output signal from the auxiliary amplifier may cause compensation of the compensation capacitor to increase based on an amount of gain provided by the input signal from the auxiliary amplifier. In that case, the compensation of the compensation capacitor stabilizes a circuit containing the LDO voltage regulator.

In another aspect, a PSRR of a circuit containing the LDO voltage regulator may improve based on an amount of gain provided by the auxiliary amplifier.

In yet another aspect, the auxiliary amplifier may include a resistive load that limits an amount of gain of the auxiliary amplifier.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The methods, sequences and/or algorithms described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal (e.g., UE). In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

While the foregoing disclosure shows illustrative embodiments of the disclosure, it should be noted that various changes and modifications could be made herein without departing from the scope of the disclosure as defined by the appended claims. The functions, steps and/or actions of the method claims in accordance with the embodiments of the disclosure described herein need not be performed in any particular order. Furthermore, although elements of the disclosure may be described or claimed in the singular, the plural is contemplated unless limitation to the singular is explicitly stated.

What is claimed is:

1. A low dropout (LDO) voltage regulator, comprising:

a differential amplifier configured to amplify a differential between a reference voltage and a regulated output voltage;

a PMOS (P-channel Metal Oxide Semiconductor) pass transistor coupled to the differential amplifier and driven by an output of the differential amplifier;

a compensation capacitor coupled to an output node of the differential amplifier; and an auxiliary amplifier comprising a low current open loop differential amplifier having a low current comprising 25 nano amps, wherein an output node of the auxiliary amplifier is coupled to the compensation capacitor, and wherein an input node of the auxiliary amplifier is coupled to the PMOS pass transistor.

2. The LDO voltage regulator of claim 1, wherein compensation of the compensation capacitor is increased based on an amount of gain provided by the auxiliary amplifier.

3. The LDO voltage regulator of claim 2, wherein the compensation of the compensation capacitor stabilizes a circuit containing the LDO voltage regulator.

4. The LDO voltage regulator of claim 1, wherein a power supply rejection ratio (PSRR) of a circuit containing the LDO voltage regulator improves based on an amount of gain provided by the auxiliary amplifier.

5. The LDO voltage regulator of claim 1, wherein the LDO voltage regulator utilizes Miller compensation.

6. The LDO voltage regulator of claim 5, wherein the auxiliary amplifier includes a resistive load that limits an amount of gain of the auxiliary amplifier.

7. The LDO voltage regulator of claim 1, wherein the LDO voltage regulator comprises a closed loop operational amplifier.

8. The LDO voltage regulator of claim 1, further comprising:

an active clamp coupled to the output node of the differential amplifier and the PMOS pass transistor.

9. The LDO voltage regulator of claim 8, wherein the active clamp limits short-circuit current surges from the PMOS pass transistor.

10. The LDO voltage regulator of claim 8, wherein the PMOS pass transistor receives a voltage of 2V to 3.6V from a battery, and wherein the LDO voltage regulator supplies an off-chip load capacitor with a voltage of 1.8V.

11. A method for compensating a low dropout (LDO) voltage regulator, comprising:

amplifying, by a differential amplifier, a differential between a reference voltage and a regulated output voltage;

receiving, at a PMOS pass transistor coupled to the differential amplifier, an output of the differential amplifier;

receiving, at a compensation capacitor, an output signal from an auxiliary amplifier, the auxiliary amplifier comprising a low current open loop differential amplifier having a low current comprising 25 nano-amps wherein the low current comprises a current of 25 nano amps, wherein the compensation capacitor is coupled to an output node of the differential amplifier, wherein an output node of the auxiliary amplifier is coupled to the compensation capacitor, and wherein an input node of the auxiliary amplifier is coupled to the PMOS pass transistor.

12. The method of claim 11, wherein the output signal from the auxiliary amplifier causes compensation of the compensation capacitor to increase based on an amount of gain provided by an input signal from the auxiliary amplifier.

13. The method of claim 12, wherein the compensation of the compensation capacitor stabilizes a circuit containing the LDO voltage regulator.

14. The method of claim 11, wherein a power supply rejection ratio (PSRR) of a circuit containing the LDO voltage regulator improves based on an amount of gain provided by the auxiliary amplifier.

15. The method of claim 11, wherein the LDO voltage regulator utilizes Miller compensation.

16. The method of claim 11, wherein the auxiliary amplifier includes a resistive load that limits an amount of gain of the auxiliary amplifier.

17. The method of claim 11, wherein the LDO voltage regulator comprises a closed loop operational amplifier.

18. The method of claim 11, further comprising:

coupling an active clamp to the output node of the differential amplifier and the PMOS pass transistor.

19. The method of claim 18, wherein the active clamp limits short-circuit current surges from the PMOS pass transistor.

20. The method of claim 18, wherein the PMOS pass transistor receives a voltage of 2V to 3.6V from a battery, and wherein the LDO voltage regulator supplies an off-chip load capacitor with a voltage of 1.8V.

21. An apparatus for compensating a low dropout (LDO) voltage regulator, comprising:

a differential amplifier configured to amplify a differential between a reference voltage and a regulated output voltage;

a PMOS pass transistor coupled to the differential amplifier and driven by an output of the differential amplifier;

a compensation means coupled to an output node of the differential amplifier; and an auxiliary low current open loop differential amplification means amplifier having a low current comprising 25 nano amps, wherein an output node of the auxiliary amplification means is coupled to the compensation means, and wherein an input node of the auxiliary amplification means is coupled to the PMOS pass transistor.

22. The apparatus of claim 21, wherein compensation of the compensation means is increased based on an amount of gain provided by the auxiliary amplification means.

23. The apparatus of claim 21, wherein a power supply rejection ratio (PSRR) of a circuit containing the LDO voltage regulator improves based on an amount of gain provided by the auxiliary amplification means.

24. A low dropout (LDO) voltage regulator, comprising:

a differential amplifier configured to amplify a differential between a reference voltage and a regulated output voltage;

a PMOS (P-channel Metal Oxide Semiconductor) pass transistor coupled to the differential amplifier and driven by an output of the differential amplifier;

a compensation capacitor coupled to an output node of the differential amplifier; and an auxiliary amplifier comprising a low current open loop differential amplifier, wherein an output node of the auxiliary amplifier is coupled to the compensation capacitor, and wherein an input node of the auxiliary amplifier is coupled to the PMOS pass transistor, wherein the differential amplifier uses a low bias current provided by a bandgap current source.

* * * * *